US006398045B1

(12) United States Patent
Chao

(10) Patent No.: US 6,398,045 B1
(45) Date of Patent: Jun. 4, 2002

(54) WATER NOZZLE RACK

(76) Inventor: Hui-Chen Chao, 75, Liau Tsuo Hsiang, Liau Tsuo Li, Lu Kang Chen, Chan Hua Hsien (TW)

( * ) Notice: Subject to any disclaimer, the term of this patent is extended or adjusted under 35 U.S.C. 154(b) by 0 days.

(21) Appl. No.: 09/796,884

(22) Filed: Mar. 2, 2001

(51) Int. Cl.[7] ..... A47F 7/00

(52) U.S. Cl. ..... 211/181.1; 211/60.1; 211/70.6; 248/75

(58) Field of Search ..... 211/70.6, 60.1, 211/70.2, 85.31, 65, 70.7, 181.1; 248/75, 80, 89

(56) References Cited

U.S. PATENT DOCUMENTS 1,290,290 A * 1/1919 Movio
2,818,980 A * 1/1958 Losching
2,987,194 A * 6/1961 Barge
4,318,478 A * 3/1982 DeWinter
D264,157 S * 5/1982 Karsikas
4,345,688 A * 8/1982 De Boer ..... 211/70.6
4,641,755 A * 2/1987 Oliver et al. ..... 211/60.1
5,011,028 A * 4/1991 Sweney ..... 211/60.1
D331,675 S * 12/1992 David
5,810,177 A * 9/1998 Cabiran ..... 211/70.6
D429,071 S * 8/2000 Hurt

* cited by examiner

*Primary Examiner*—Robert W. Gibson, Jr.
(74) *Attorney, Agent, or Firm*—Harrison & Egbert

(57) ABSTRACT

A water nozzle rack includes a plurality of upright support rods, a top shelf fixed horizontally to top ends of the upright support rods, and a plurality of support shelves located under the top shelf and fixed horizontally to the upright support rods. The top shelf is provided with a plurality of nozzle-locating loops for holding the barrels of the nozzles.

1 Claim, 3 Drawing Sheets

WATER NOZZLE RACK

BACKGROUND

1. Field of the Invention

The present invention relates generally to a rack, and more particularly to a water nozzle rock.

2. Description of Related Art

Gardening, such as sprinklers, nozzles, rakes, shovels, lawn mowers, spreaders, etc., are generally kept in a garage along with other household items. As far as water nozzles are concerned, a user often takes time to look for the nozzles in the event that they are not kept in an organized manner in the garage. In addition, the nozzles are susceptible to damage if they are not kept in a proper place.

BRIEF SUMMARY OF THE INVENTION

The primary objective of the present invention is to provide a water nozzle rack for holding a plurality of nozzles in an organized manner.

In keeping with the principle of the present invention, the foregoing objective of the present invention is attained by the water nozzle rack comprising a plurality of upright support rods and shelves fixed horizontally to the upright support rods. The top shelf is provided with means to hold the nozzles.

The features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
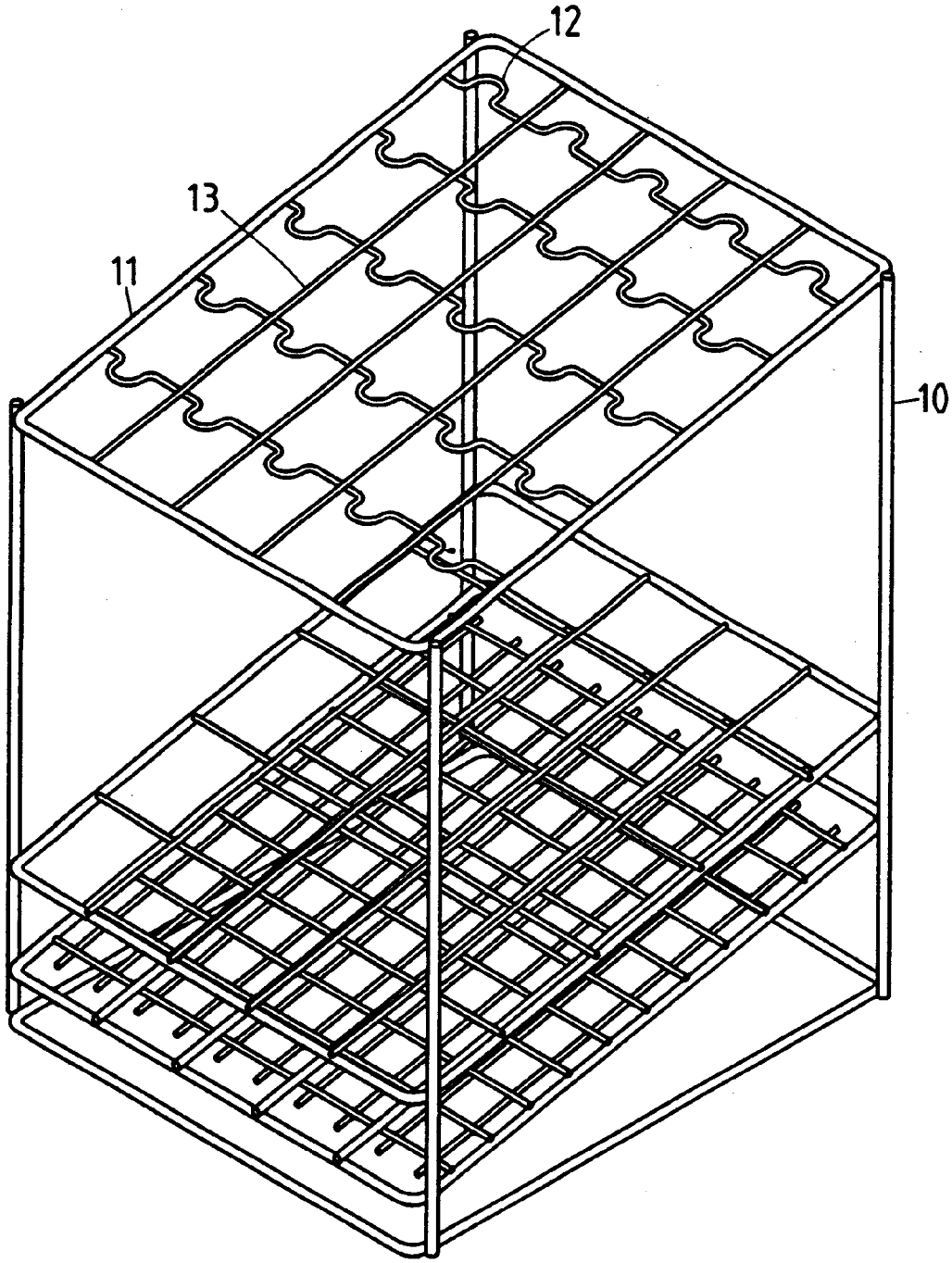
FIG. 1 shows a perspective view of the preferred embodiment of the present invention.
Figure 2:
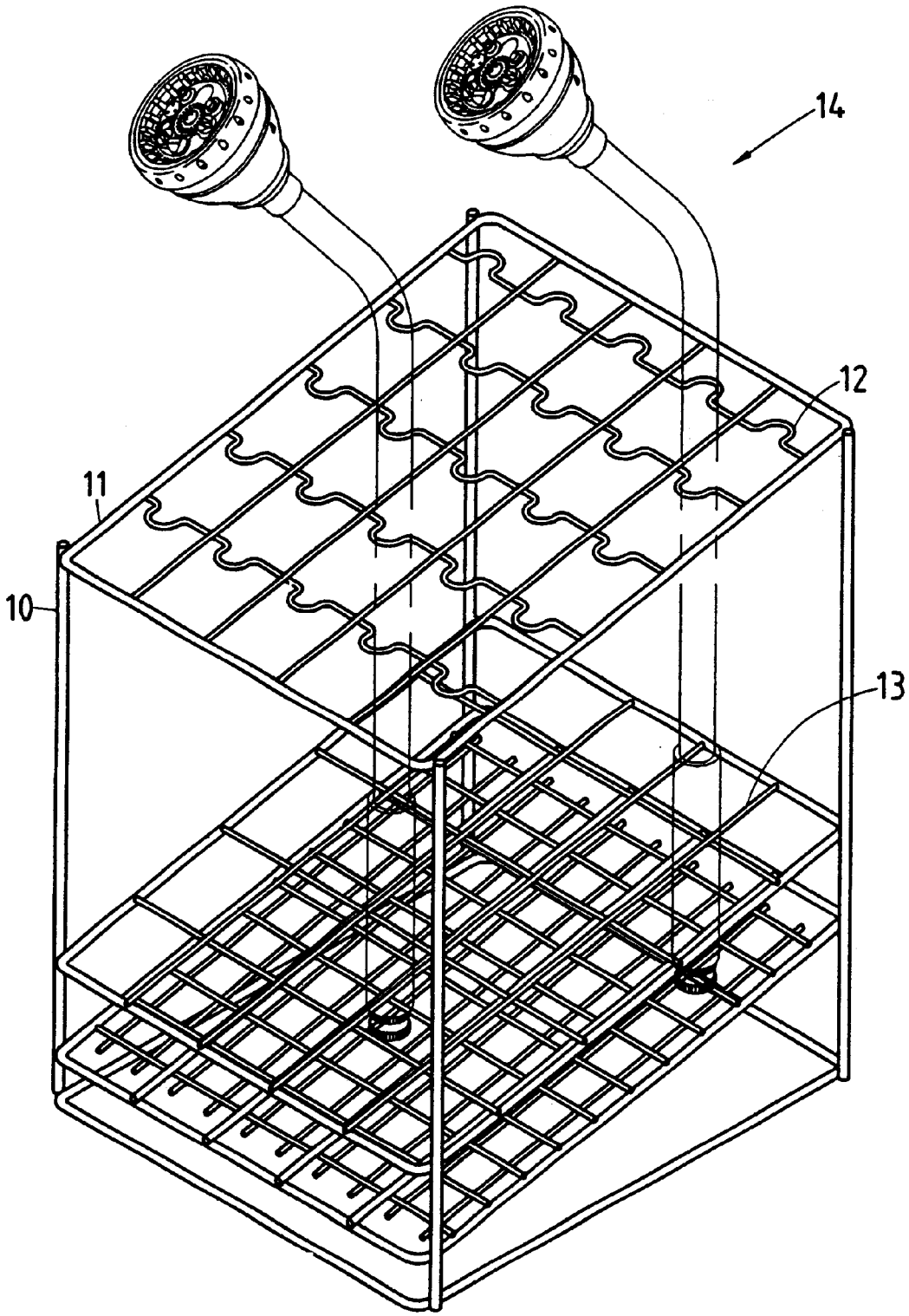
FIG. 2 shows a schematic view of the preferred embodiment of the present invention in use.
Figure 3:
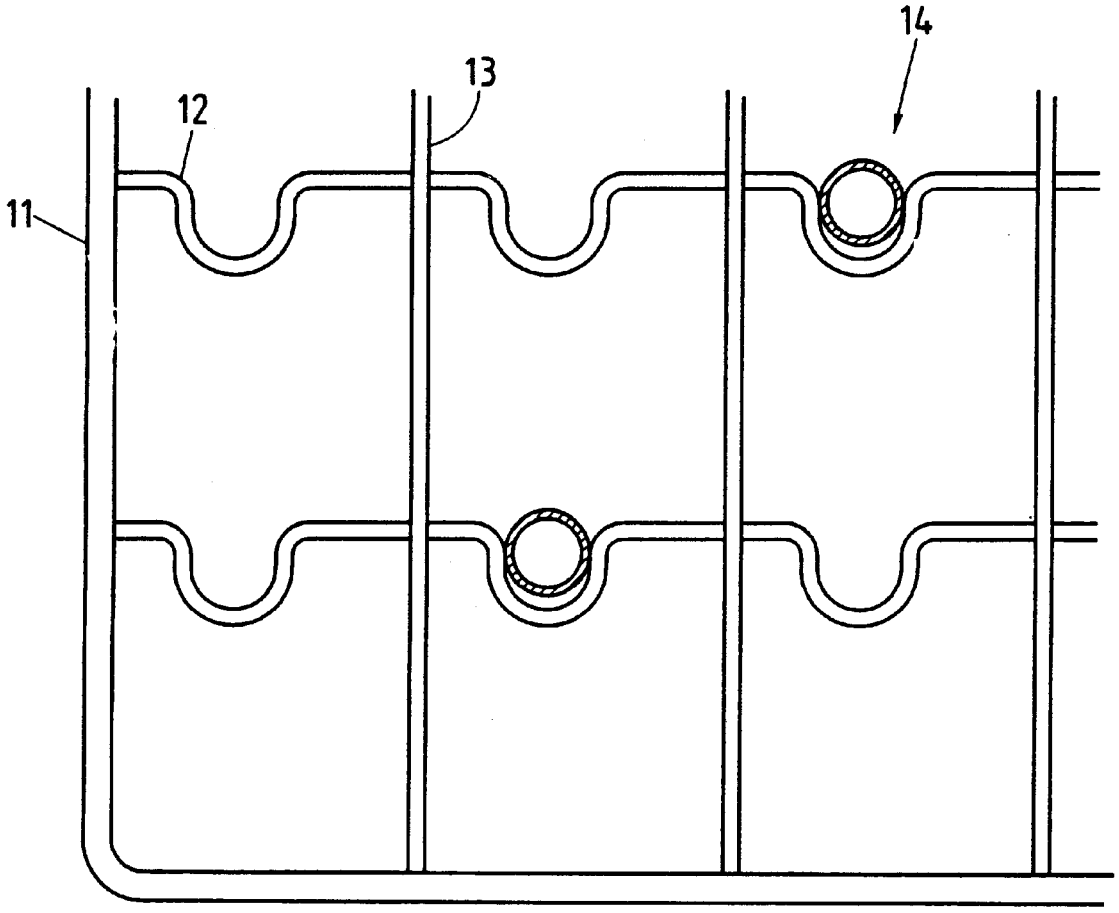
FIG. 3 shows a partial top plan view of the preferred embodiment of the present invention is use.

A shown in FIGS. 1–3, a water nozzle rack embodied in the present invention comprises a plurality of upright support rods 10 and a plurality of shelves fastened horizontally to the upright support rods 10.

With the exception of the top shelf, the support shelves are formed of a plurality of straight bars 13, which are parallel to one another and are crossed at intervals by other straight bars 13. These support shelves are fixed horizontally to the upright support rods 10 such that they are located under the top shelf, and that they are separated from one another by a predetermined distance.

The nozzle rack of the present invention is characterized by the top shelf which is formed of a plurality of parallel straight bars 13 crossed at intervals by a plurality of nozzle-locating bars 12. Each nozzle-locating bar 12 is provided at an interval with a plurality of nozzle-locating loops which are integrally made with the nozzle-locating bar 12 for locating the barrels of the water nozzles 14, as illustrated in FIGS. 2 and 3.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

I claim:

1. A water nozzle rack comprising:

a plurality of upright support rods;

a top shelf fixed horizontally to top ends of said upright support rods; and a plurality of support shelves fixed horizontally to said upright support rods wherein said support shelves are located under said top shelf, and wherein said support shelves are separated from one another by a distance, said support shelves being comprised of a plurality of parallel straight bars crossed at intervals by other straight bars;

wherein said top shelf is comprised of a plurality of parallel straight bars crossed at intervals by a plurality of nozzle-locating bars, with each of said nozzle-locating bars having a plurality of nozzle-locating loops which are integrally made with said nozzle-locating bar and are separated from one another by a distance.

* * * * *